US005474699A

United States Patent [19]

Ahmed et al.

[11] Patent Number: 5,474,699

[45] Date of Patent: Dec. 12, 1995

[54] PHOSPHATE CONTAINING POWERED AUTOMATIC DISHWASHING COMPOSITION WITH ENZYMES

[75] Inventors: Fahim U. Ahmed, Plainsboro, N.J.; Julien Drapier, Seraing; Patrick Durbut, Verviers, both of Belgium

[73] Assignee: Colgate-Palmolive Co., Piscastaway, N.J.

[21] Appl. No.: 274,102

[22] Filed: Jul. 11, 1994

Related U.S. Application Data

[63] Continuation of Ser. No. 938,070, Aug. 31, 1992, abandoned, which is a continuation-in-part of Ser. No. 797,605, Nov. 25, 1991, abandoned, which is a continuation-in-part of Ser. No. 708,568, May 31, 1991, abandoned, and a continuation-in-part of Ser. No. 708,565, May 31, 1991, abandoned, and a continuation-in-part of Ser. No. 708,569, May 31, 1991, abandoned.

[51] Int. Cl.[6] ..... C11D 3/386; C11D 3/395; C11D 3/37

[52] U.S. Cl. ..... 252/99; 252/174.14; 252/173; 252/174.13; 252/135; 252/DIG. 11; 252/174.25

[58] Field of Search ..... 252/174.12, DIG. 12, 252/174.14, 173, 99, 174.23, 135, DIG. 11, 124.25

[56] References Cited

U.S. PATENT DOCUMENTS

| | | | |
|---|---|---|---|
| 4,016,040 | 4/1977 | Win et al. | 195/68 |
| 4,101,457 | 7/1978 | Place et al. | 252/559 |
| 4,162,987 | 7/1979 | Maguire et al. | 252/135 |
| 4,438,014 | 3/1984 | Scott | 252/174.21 |
| 4,597,886 | 7/1986 | Goedhart et al. | 252/95 |
| 4,620,936 | 11/1986 | Kielman | 252/99 |
| 4,919,845 | 4/1990 | Vogt et al. | 252/526 |
| 4,931,203 | 6/1990 | Ahmed | 252/99 |
| 5,030,379 | 7/1991 | Knight | 252/174.25 |
| 5,112,518 | 5/1992 | Klugkist | 252/174.12 |
| 5,173,207 | 12/1992 | Drapier | 252/99 |
| 5,205,954 | 4/1993 | Ahmed et al. | 252/99 |

FOREIGN PATENT DOCUMENTS

| | | |
|---|---|---|
| 3883047 | 5/1990 | Germany . |

*Primary Examiner*—Christine Skane
*Assistant Examiner*—Kery Fries
*Attorney, Agent, or Firm*—Richard E. Nanfeldt; Robert C. Sullivan; Murray Grill

[57] ABSTRACT

A powdered dishwashing composition containing a mixture of protease enzyme and an amylase enzymes have been found to be very useful in the cleaning of dishware. The compositions can contain a nonionic surfactants, phosphate builder salt, and an alkali metal silicate and optionally a bleaching agent.

14 Claims, No Drawings

PHOSPHATE CONTAINING POWERED AUTOMATIC DISHWASHING COMPOSITION WITH ENZYMES

RELATED APPLICATION

This application is a continuation of application Ser. No. 07/938,070 filed on Aug. 31, 1992, which is a continuation in part of U.S. Ser. No. 07/797,605, filed Nov. 25, 1991 which in turn is a continuation in part application of U.S. Ser. No. 07/708,568 filed May 30, 1991 and is also a continuation in part application of U.S. Ser. No. 07/708,565, filed May 31, 1991 and is also in continuation in part application of U.S. Ser. No. 07/708,569 filed May 31, 1991, all of which are now abandoned.

FIELD OF THE INVENTION

This invention relates to an improved phosphate-containing powdered automatic dishwashing detergent for dishwashing machines. More particularly, this invention relates to a concentrated powdered dishwashing composition which contains enzymes that can function at a low alkalinity and high operating temperatures.

BACKGROUND OF THE INVENTION

It has been found to be very useful to have enzymes in dishwashing detergent compositions because enzymes are very effective in removing food soils from the surface of glasses, dishes, pots, pans and eating utensils. The enzymes attack these materials while other components of the detergent will effect other aspects of the cleaning action. However, in order for the enzymes to be highly effective, the composition must be chemically stable, and it must maintain an effective activity at the operating temperature of the automatic dishwasher. Chemical stability, such as to bleach agents, is the property whereby the detergent composition containing enzymes does not undergo any significant degradation during storage. Activity is the property of maintaining enzyme activity during usage. Front the time that a detergent is packaged until it is used by the customer, it must remain stable. Furthermore, during customer usage of the dishwashing detergent, it must retain its activity. Unless the enzymes in the detergent are maintained in a minimum exposure to moisture and water, the enzymes will suffer a degradation during storage which will result in a product that will have a decreased activity. When enzymes are a part of the detergent composition, it has been found that the initial water content of the components of the composition should be as low a level as possible, and this low water content must be maintained during storage, since water in the alkaline product will deactivate the enzymes. This deactivation will cause a decrease in the initial activity of the detergent composition.

After the detergent container is opened, the detergent will be exposed to the environment which contains moisture. During each instance that the detergent is exposed to the environment it could possibly absorb some moisture. This absorption occurs by components of the detergent composition absorbing moisture, when in contact with the atmosphere. This effect is increased as the container is emptied, since there will be a greater volume of air in contact with the detergent, and thus more available moisture to be absorbed by the detergent composition. This will usually accelerate the decrease in the activity of the detergent composition. The most efficient way to keep a high activity is to start with an initial high activity of enzyme and to use components in the dishwashing composition which do not interact with the enzyme or have a low water affinity which will minimize any losses in activity as the detergent is being stored or used.

Powdered detergent compositions which contain enzymes can be made more stable and to have a high activity, if the initial free water content of the detergent composition is less than about 10 percent by weight, more preferably less than about 9 percent by weight and most preferably less than about 8 percent by weight. Furthermore, the pH of a 1.0 wt % aqueous solution of the powdered detergent composition should be less than about 11.0 more preferably less than about 10.6, and most preferably less than about 10.3. This low alkalinity of the dishwashing detergent should maintain the stability of the detergent composition which contains a mixture of enzymes, thereby providing a higher initial activity of the mixture of the enzymes and the maintenance of this initial high activity.

A major concern in the use of automatic dishwashing compositions is the formulation of automatic dishwashing compositions which have a low alkalinity and can operate at a high temperature while maintaining superior cleaning performance and dish care. The present invention teaches the preparation and use of powdered automatic dishwashing compositions which are phosphate containing and have superior cleaning performance and dish care and are used at operating temperatures of 100° F. to 140° F.

SUMMARY OF THE INVENTION

This invention is directed to producing powdered phosphate enzyme-containing automatic dishwashing detergent compositions that have an increased chemical and enzyme stability as evidenced by retained enzyme activity during storage and essentially a higher enzyme activity at wash operating temperatures of about 40° C. to 65° C. (about 104° F. to 150° F.), wherein the composition also can be used as a laundry pre-soaking agent. This is accomplished by controlling the alkalinity of the detergent composition and using a unique mixture of enzymes. An alkali metal silicate is used in the powdered dishwashing detergent compositions. The preferred builder system of the instant compositions comprises at least one phosphate builder salt which can be used in conjunction with a polymeric builder salts and non-phosphate containing builder salts.

It is to be understood that the term powder in this invention includes within its definition tablets, soluble capsules and soluble sachet. It is also possible to use the instant compositions as a laundry presoaking powder.

Conventional powdered automatic dishwashing compositions can also contain a low foaming surface-active agent, a chlorine bleach, alkaline builder materials, and usually minor ingredients and additives. The incorporation of chlorine bleaches requires special processing and storage precautions to protect composition components which are subject to deterioration upon direct contact with the active chlorine. The stability of the chlorine bleach is also critical and raises additional processing and storage difficulties. In addition, it is known that automatic dishwasher detergent compositions may tarnish silverware and damage metal trim on china as a result of the presence of a chlorine-containing bleach therein. Accordingly, there is a standing desire to formulate detergent compositions for use in automatic dishwashing operations which are free of active chlorine and which are capable of providing overall hard surface cleaning and appearance benefits comparable to or better than active chlorine-containing detergent compositions. This reformulation is particularly delicate in the context of automatic dishwashing operations, since during those operations, the active chlorine prevents the formation and/or deposition of troublesome protein and protein-grease complexes on the hard dish surfaces and no surfactant system currently known is capable of adequately performing that function.

Various attempts have been made to formulate bleach-free low foaming detergent compositions for automatic dishwashing machines, containing particular low foaming nonionics, builders, filler materials and enzymes. U.S. Pat. No. 3,472,783 to Smille recognized that degradation of the enzyme can occur, when an enzyme is added to a highly alkaline automatic dishwashing detergent.

French Patent No. 2,102,851 to Colgate-Palmolive, pertains to rinsing and washing compositions for use in automatic dishwashers. The compositions disclosed have a pH of about 6 to 7 and contain an amylolytic and, if desired, a proteolytic enzyme, which have been prepared in a special manner from animal pancreas and which exhibit a desirable activity at a pH in the range of about 6 to 7. German Patent No. 2,038,103 to Henkel & Co. relates to aqueous liquid or pasty cleaning compositions containing phosphate salts, enzymes and an enzyme stabilizing compound. U.S. Pat. No. 3,799,879 to Francke et at, teaches a detergent composition for cleaning dishes, with a pH of from 7 to 9 containing an amylolytic enzyme, and in addition, optionally a proteolytic enzyme.

U.S. Pat. No. 4,101,457, to Place et at., teaches the use of a proteolytic enzyme having a maximum activity at a pH of 12 in an automatic dishwashing detergent.

U.S. Pat. No. 4,162,987, to Maguire et at., teaches a granular or liquid automatic dishwashing detergent which uses a proteolytic enzyme having a maximum activity at a pH of 12 as well as an amylolytic enzyme having a maximum activity at a pH of 8.

U.S. Pat. No. 3,827,938, to Aunstrup et at., discloses specific proteolytic enzymes which exhibit high enzymatic activities in highly alkaline systems. Similar disclosures are found in British Patent Specification No. 1,361,386, to Novo Terapeutisk Laboratorium A/S, British Patent Specification No. 1,296,839, to Novo Terapeutisk Laboratorium A/S, discloses specific amylolytic enzymes which exhibit a high degree of enzymatic activity in alkaline systems.

Thus, while the prior art clearly recognizes the disadvantages of using aggressive chlorine bleaches in automatic dishwashing operations and also suggests bleach-free compositions made by leaving out the bleach component, said an disclosures are silent about how to formulate an effective bleach-free powdered automatic dishwashing compositions capable of providing superior performance during conventional use.

U.S. Pat. Nos. 3,821,118 and 3,840,480; 4,568,476, 4,501, 681 and 4,692,260 teach the use of enzymes in automatic dishwashing detergents, as well as Belgian Patent 895,459; French Patents 2,544,393 and 1,600,256; European Patents 256,679; 266,904; 271,155; 139,329; and 135,226; and Great Britain Patent 2,186,884.

The aforementioned prior art fails to provide a stable powdered automatic dishwashing detergent which is phosphate-containing and contains a mixture of enzymes as well as optionally, a peroxygen compound with an activator for the simultaneous degradation of both proteins and starches, wherein the combination of anylase and protease enzymes have a maximum activity at a pH of less than 11.0 and the powdered automatic dishwashing detergent has high cleaning performance in a temperature range of about 40° C. to about 65° C. (about 100° F. to 150° F.) as well as having improved enzyme stability during storage. It is an object of this invention to incorporate a novel enzyme mixture in a phosphate-containing, powdered automatic dishwasher detergent composition for use in automatic dishwashing operations capable of providing at least equal or better performance to conventional automatic dishwashing compositions at operating temperatures of about 40° C. to about 65° C.

DETAILED DESCRIPTION

The present invention relates to a powdered automatic dishwashing detergent compositions which comprise a nonionic surfactant, alkali metal silicate, a phosphate-containing builder system, optionally, a peroxygen compound with an activator as a bleaching agent and a mixture of an amylase enzyme and a protease enzyme, wherein the powdered automatic dishwashing detergent composition has a pH of less than 11.0 and the powdered dishwashing detergent composition exhibits high cleaning efficiency for both proteins and starches at a wash temperature of about 40° C. to about 65° C. (about 100° F. to about 150° F.).

The composition of the present invention comprise approximately by weight;

(a) 10 to 65%, more preferably 15 to 65% of at least one alkali metal phosphate builder salt;

(b) 0 to 30%, more preferably 1 to 25% of at least one alkali metal phosphate free builder salt;

(c) 0 to 20%, more preferably 1 to 20% of at least one low molecular weight non-cross-linked polyacrylate polymer;

(d) 0 to 30%, more preferably 3.0 to 30% of an alkali metal silicate;

(e) 0 to 15%, more preferably 0.5 to 10.0% of a liquid nonionic surfactant;

(f) 0 to 1.5%, more preferably 0. 1 to 1.5% of an anti-foaming agent;

(g) 0.5 to 15%, more preferably 1.0 to 12% of at least one protease enzyme;

(h) 0.3 to 8%, more preferably 0.5 to 6.0% of an amylase enzyme;

(i) 0 to 20%, more preferably 1.0 to 17% of a peroxygen bleaching agent;

(j) 0 to 7%, more preferably 1 to 5% of a peroxygen bleach activator;

(k) 0 to 8.0%, more preferably 0 to 6% of a lipase enzyme; and (l) 30 to 30% of a filler or extender such as an alkali metal sulfate.

The nonionic surfactants that can be used in the present powdered automatic dishwasher detergent compositions are well known. A wide variety of these surfactants can be used.

The nonionic synthetic organic detergents are generally described as ethoxylated propoxylated fatty alcohols which are low-foaming surfactants and may be possibly capped, characterized by the presence of an organic hydrophobic group and an organic hydrophilic group and are typically produced by the condensation of an organic aliphatic or alkyl aromatic hydrophobic compound with ethylene oxide and/or propyleneoxide (hydrophilic in nature). Practically any hydrophobic compound having a carboxy, hydroxy, amide or amino group with a free hydrogen attached to the oxygen or the nitrogen can be condensed with ethylene oxide or propylene oxide or with the polyhydration product thereof, polyethylene glycol, to form a nonionic detergent. The length of the hydrophilic or polyoxyethylene chain can be readily adjusted to achieve the desired balance between the hydrophobic and hydrophilic groups. Typical suitable nonionic surfactants are those disclosed in U.S. Pat. Nos. 4,316,812 and 3,630,929.

Preferably, the nonionic detergents that are used are the low-foaming polyalkoxylated lipophiles wherein the desired hydrophile-lipophile balance is obtained from addition of a hydrophilic poly-lower alkoxy group to a lipophilic moiety. A preferred class of the nonionic detergent employed is the poly-lower alkoxylated higher alkanol wherein the alkanol is of 9 to 18 carbon atoms and wherein the number of moles of lower alkylene oxide (of 2 or 3 carbon atoms) is from 3 to 15. Of such materials it is preferred to employ those wherein the higher alkanol is a high fatty alcohol of 9 to 11 or 12 to 15 carbon atoms and which contain from 5 to 15 or 5 to 16 lower alkoxy groups per mole. Preferably, the lower alkoxy is ethoxy but in some instances, it may be desirably mixed with propoxy, the latter, if present, usually being major (more than 50%) portion. Exemplary of such compounds are those wherein the alkanol is of 12 to 15 carbon atoms and which contain about 7 ethylene oxide groups per mole.

Useful nonionics are represented by the low foam Plurafac series from BASF Chemical Company which are the reaction product of a higher linear alcohol and a mixture of ethylene and propylene oxides, containing a mixed chain of ethylene oxide and propylene oxide, terminated by a hydroxyl group. Examples include Product A (a $C_{13}$–$C_{15}$ fatty alcohol condensed with 6 moles ethylene oxide and 3 moles propylene oxide). Product B (a $C_{13}$–$C_{15}$ fatty alcohol condensed with 7 mole propylene oxide and 4 mole ethylene oxide), and Product C (a $C_{13}$–$C_{15}$ fatty alcohol condensed with 5 moles propylene oxide and 10 moles ethylene oxide). Another group of liquid nonionics are available from Shell Chemical Company, Inc. under the Dobanol trademark: Dobanol 91-5 is a low foam ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles ethylene oxide. Another liquid nonionic surfactant that can be used is sold under the tradename Lutensol SC 9713.

Synperonic nonionic surfactants from ICI such as Synperonic LF/D25 LF/RA30 are especially preferred nonionic surfactants that can be used in the powdered automatic dishwasher detergent compositions of the instant invention.

Poly-Tergent nonionic surfactants from Olin Organic Chemicals such as Poly-Tergent SLF-18, a biodegradable, low-foaming surfactant is specially preferred for the powdered automatic dishwasher detergent compositions of this instant invention. Poly-Tergent SLF-18 which is alkoxylated linear alcohol and water dispersible and has a low cloud point and lower surface tension and lower foaming is very suitable for automatic dishwasher detergent.

Other useful surfactants are Neodol 25-7 and Neodol 23-6.5, which products are made by Shell Chemical Company, Inc. The former is a condensation product of a mixture of higher fatty alcohols averaging about 12 to 13 carbon atoms and the number of ethylene oxide groups present averages about 6.5. The higher alcohols are primary alkanols. Other examples of such detergents include Tergitol 15-S-7 and Tergitol 15-S-9 (registered trademarks), both of which are linear secondary alcohol ethoxylates made by Union Carbide Corp. The former is mixed ethoxylation product of 11 to 15 carbon atoms linear secondary alkanol with seven moles of ethylene oxide and the latter is a similar product but with nine moles of ethylene oxide being reacted.

Also useful in the present compositions as a component of the nonionic detergent are higher molecular weight nonionics, such as Neodol 45-11, which are similar ethylene oxide condensation products of higher fatty alcohols, with the higher fatty alcohol being of 14 to 15 carbon atoms and the number of ethylene oxide groups per mole being about 11. Such products are also made by Shell Chemical Company.

In the preferred poly-lower alkoxylated higher alkanols, to obtain the best balance of hydrophilic and lipophilic moieties the number of lower alkoxies will usually be from 40% to 100% of the number of carbon atoms in the higher alcohol, preferably 40 to 60% thereof and the nonionic detergent will preferably contain at least 50% of such preferred poly-lower alkoxy higher alkanol.

The alkylpolysaccharides are surfactants which are also useful alone or in conjunction with the aforementioned surfactants and those having a hydrophobic group containing from about 8 to about 20 carbon atoms, preferably from about 10 to about 16 carbon atoms, most preferably from 12 to 14 carbon atoms, and polysaccharide hydrophilic group containing from 1.5 to about 10, preferably from about 1.5 to 4, and most preferably from 1.6 to 2.7 saccharide units (e.g., galactoside, glucoside, fructoside, glucosyl, fructosyl, and/or galactosyl units). Mixtures of saccharide moieties may be used in the alkyl polysaccharide surfactants. The letter x indicates the number of saccharide units shown later in a particular alkylpolysaccharide surfactant formula. For a particular alkylpolysaccharide molecule x can only assume integral values. In any physical sample can be characterized by the average value of x and this average value can assume non-integral values. In this specification the values of x are to be understood to be average values. The hydrophobic group (R) can be attached at the 2-, 3-, or 4- positions rather than at the 1-position, (thus giving e.g. a glucosyl or galactosyl as opposed to a glucoside or galactoside). However, attachment through the 1-position, i.e., glucosides, galactosides, fructosides, etc., is preferred. In the preferred product the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 16 carbon atoms. Preferably, the alkyl group is a straight chain saturated alkyl group. The alkyl group can contain up to 3 hydroxy groups and/Or the polyalkoxide chain can contain up to about 30, preferably less than 10, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula:

$$R_2O(C_nH_{2n}O)r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from 12 to 14 carbon atoms; n is 2 or 3 preferably 2, r is from 0 to about 10, preferable 0; and x is from 1.5 to about 8, preferably from 1.5 to 4, most preferably from 1.6 to 2.7. To prepare these compounds a long chain alcohol ($R_2OH$) can be reacted with glucose, in the presence of an acid catalyst to form the desired glucoside. Alternatively the alkyl polyglucosides can be prepared by a two step procedure in which a short chain alcohol ($R_1OH$) an be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucoside content of the final alkyl polyglucoside material should be less than 50%, preferably less than 10%, more preferably less than 5%, most preferably 0% of the alkyl polyglucoside.

The mount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereo chemistry of the saccharide moiety is changed during the preparation reaction.

An especially preferred APG glycoside surfactant is APG 625 glycoside manufactured by the Henkel Corporation of Ambler, Pa. APG 25 is a nonionic alkyl polyglycoside characterized by the formula:

$$C_nH_{2n+1}O(C_6H_{10}O_5)_xH$$

wherein n=10(2%); n=12(65%); n=14(21–28%); n=16(4–8%) and n=18(0.5%) and x(degree of polymerization)=1.6. APG 625 has: a pH of 6–8(10% of APG 625 in distilled water); a specific gravity at 25° F. of 1.1 grams/ml; a density at 25° F. of 9.1 kgs/gallons; a calculated HLB of about 12.1 and a Brookfield viscosity at 35° C., 21 spindle, 5–10 RPM of about 3,000 to about 7,000 cps. Mixtures of two or more of the liquid nonionic surfactants can be used and in some cases advantages can be obtained by the use of such mixtures.

The liquid nonaqueous nonionic surfactant is absorbed on a builder system which comprises a phosphate-containing particles which is a builder salt and optionally a low molecular weight polyacrylate type polymer such as a polyacrylate, organic and/or inorganic detergent builders as well as phosphate free builder salts such as an alkali carbonate such as sodium carbonate or sodium citrate or a mixture of sodium carbonate and sodium citrate. The nonaqueous liquid nonionic surfactant has dispersed therein free particles or organic and/or inorganic detergent builders. Preferred solid builder salts are an alkali metal polyphosphate such as sodium tripolyphosphate ("TPP"), potassium tripolyphosphate or potassium pyrophosphates and mixtures thereof. The TPP is a blend of anhydrous TPP and a small amount of TPP hexahydrate such that the chemically bound water content is about 1%, which corresponds to about one $H_2O$ per pentasodium tripolyphosphate molecule. Such TPP may be produced by treating anhydrous TPP with a limited amount of water. The presence of the hexahydrate slows down the rapid rate of solution of the TPP in the wash bath and inhibits caking. One suitable TPP is sold under the name Thermphos NW. The particles size of the Thermphos NW TPP, as supplied usually averages about 200 microns with the largest particles being about 400 microns. In place of all or part of the alkali metal polyphosphate one or more non phosphate detergent builder salts can be used. Suitable non phosphate builder salts are alkali metal carbonates, borates, bicarbonates, citrates, lower polycarboxylic acid salts, and polyacrylates, polymaleic anhydrides and copolymers of polyacrylates and polymaleic anhydrides and polyacetal carboxylates.

Specific examples of builder salts useful in the instant composition are sodium carbonate, potassium carbonate, sodium tetraborate, sodium pyrophosphate, sodium tripolyphosphate, potassium tripolyphosphate, potassium pyrophosphate, sodium bicarbonate, sodium hexametaphosphate, sodium sesquicarbonate, sodium mono and diorthophosphate, and potassium bicarbonate. The builder salts can be used alone with the nonionic surfactant or in an admixture with other builders. Typical builders also include those disclosed in U.S. Pat Nos. 4,316,812, 4,264,466, and 3,630,929 and those disclosed in U.S. Patent Nos. 4,144,226, 4,135,092 and 4,146,495, all of which are herein incorporated by reference.

Other phosphate-free builder salts which can be mixed with the phosphate containing builder salts are alkali metal carbonates, citrates, gluconates, phosphonates and nitriloacetic acid salts. In conjunction with the builder salts are optionally used a low molecular weight non-crosslinked polyacrylates having a molecular weight of about 1,000 to about 100,000, more preferably about 2,000 to about 80,000. A preferred low molecular weight polyacrylate is Sokalan™CP45 or Sokalan™CP5 manufactured by BASF and having a molecular weight of about 70,000. Another preferred low molecular weight polyacrylate is Acrysol™LMW45ND manufactured by Rohm and Haas and having a molecular weight of about 4,500. Noroso™WL2 comprises 26% LMV 45ND sprayed on 74% sodium carbonate.

Sokalan™CP45 or CP5 is a copolymer of an acrylic acid and a maleic acid anhydride. Such a material should have a water absorption at 38° C. and 78 percent relative humidity of less than about 40 percent and preferably less than about 30 percent. The builder is commercially available under the tradename of Sokalan™CP45. This is a partially neutralized copolymer of acrylic acid and maleic anhydride sodium salt. Sokalan™CP45 is classified as a suspending and anti-deposition agent. This suspending agent has a low hygroscopicity. Another builder salt is Sokalan™CP5 having a molecular weight of 70,000 which is a completely neutralized version of CP45. An objective is to use suspending and anti-redeposition agents that have a low hygroscopicity. Copolymerized polyacids have this property, and particularly when partially neutralized. Acusol™64ND provided by Rohm Haas is another useful suspending agent.

Another class of builders useful herein are the aluminosilicates, both of the crystalline and amorphous type. Various crystalline zeolites (i.e. alumino-silicates) are described in British Patent No. 1,504,168, U.S. Patent No. 4,409,136 and Canadian Patent Nos. 1,072,835 and 1,087,477. An example of amorphous zeolites useful herein can be found in Belgium Patent No. 835,351. The zeolites generally have the formula $$(M_2O)_x(Al_2O_3)_y(SiO_2)_z\ wH_2O$$

wherein x is 1, y is from 0.8 to 1.2 and preferably 1, z is from 1.5 to 3.5 or higher and preferably 2 to 3 and w is from 0 to 9, preferably 2.5 to 6 and M is preferably sodium. A typical zeolite is type A or similar structure, with type 4A particularly preferred. The preferred aluminosilicates have calcium ion exchange capacities of about 200 milliequivalents per gram or greater, e.g. 400 meq/g.

The alkali metal silicates are useful anti-corrosion agents which function to make the composition anti-corrosive to eating utensils and to automatic dishwashing machine parts. Sodium silicates of $Na_2O:SiO_2$ ratios of from 1:1 to 1:2.4. Potassium silicates of the same ratios can also be used. The preferred silicates are sodium disilicate and sodium metasilicate.

Essentially, any compatible anti-foaming agent can be used. Preferred anti-foaming agents are silicone anti-foaming agents. These are alkylated polysiloxanes and include polydimethyl siloxanes, polydiethyl siloxanes, polydibutyl siloxanes, phenyl methyl siloxanes, trimethysilanated silica and triethylsilanated silica. A suitable anti-foaming agent is Silicone TP-201 from Union Carbide. Other suitable anti-foaming agents are Silicone DB700, DB100 used at about 0.2 to about 1.0 percent by weight, sodium stearate used at a concentration level of about 0.5 to 1.0 weight percent and 1.0 weight percent, and LPKn 158 (phosphoric ester) sold by Hoechst used at a concentration level of about 0 to about 1.5 weight percent, more preferably about 0.1 to about 1.0 weight percent. The perfumes that can be used include lemon perfume and other natural scents. Essentially, any opacifier that is compatible with the remaining components of the detergent formulation can be used. A useful and preferred opacifier is titanium dioxide at a concentration level of about 0 to about 1.0 weight percent.

A key aspect is to keep the free water (non-chemically bounded water) in the detergent composition at a minimum. Absorbed and adsorbed water are two types of free water, and comprise the usual free water found in a detergent composition. Free water will have the affect of deactivating the enzymes.

The detergent composition can include a filler or extender such as an alkali metal sulfate (sodium sulfate) at a concentration of 0 to about 30.0 wt. percent, more preferably about 1 to about 25.0 wt. percent.

The detergent composition of the present invention can include a peroxygen bleaching agent at a concentration level of about 0 to about 20 weight percent, more preferably about 0.5 to about 17 weight percent and most preferably at about 1.0 to about 14 weight percent. The oxygen bleaching agents that can be used are alkali metal perborate, percarbonate, perphthalic acid, perphosphates, and potassium monopersulfate. A preferred compound is sodium perborate monohydrate and dihydrate. The peroxygen bleaching compound is preferably used in admixture with an activator at a concentration of about 1 to about 5 weight percent. Suitable activators are those disclosed in U.S. Pat. No. 4,264,466 or in column 1 of U.S. Pat. No. 4,430,244, both of which are herein incorporated by reference. Polyacetylated compounds are preferred activators. Suitable preferred activators are tetraacetyl ethylene diamine ("TAED"), pentaacetyl glucose and ethylidenebenzoate acitate.

The activator usually interacts with the peroxygen compound to form a peroxyacid bleaching agent in the wash water.

The detergent formulation also contains a mixture of a protease enzyme and an amylase enzyme and, optionally, a lipase enzyme that serve to attack and remove organic residues on glasses, plates, pots, pans and eating utensils. Lipolytic enzymes can also be used in the powdered automatic dishwasher detergent composition. Proteolytic enzymes attack protein residues, lipolytic enzymes fat residues and amylolytic enzymes starches. Proteolytic enzymes include the protease enzymes subtilisn, bromelin, papain, trypsin and pepsin. Amylolytic enzymes include amylase enzymes. Lipolytic enzymes include the lipase enzymes. The preferred amylase enzyme is available under the name Maxamyl, derived from Bacillus licheniformis and is available from Gist-brocades of the Netherlands in a prill form (Maxamyl CXT) (activity of about 5,000 TAU/g). One preferred protease enzyme is available under the name Maxatase, and is derived from a novel Bacillus strain designated "PB92" wherein a culture of the Bacillus is deposited with the Laboratory for Microbiology of the Technical University of Delft and has the number OR-60. Maxatase protease enzyme is a low alkaline B. licheniformis protease 600,000 DU/g which is supplied in a nonaqueous slurry (18 weight percent) by International BioSynthetics (Gist-Brocades). One of the preferred protease enzyme is available under the name Protein Engineered Maxacal or Maxapem 15 or Maxapem 42 (PEM 42) and is derived from Bacillus alcalophylus which is a high alkaline mutant proteolytic enzyme and is available from Gist-Brocades, of the Netherlands. Maxapem 42 is supplied in a nonaqueous slurry (18 wt. % of enzyme/activity of 900,000 AD u/g). Preferred enzyme activities per wash are Maxapem 42 per wash and Maxamyl 4,000–10,000 TAU per wash. Maxapem 15 is supplied in a nonaqueous slurry (5.55% wt. of enzyme with activity 40,000 ADU/g and preferred enzyme activity of Maxapem 15 is 400–900 KADU per wash. Maxatase and Maxapem can be used together. Maxapem 42 protease enzyme is supplied in a nonaqueous slurry (18 weight percent) by International BioSynthetics (Gist-Brocades). Maxamyl amylase enzyme is a thermostable B. licheniformis alpha-amylase (39,500 TAU/g) which is supplied in a nonaqueous slurry (18 weight percent) by International BioSynthetics (Gist Brocades). At a concentration level of 3.5% of Protein Engineered Maxapem 42 and 1.0% of Maxamyl in the instant automatic dishwashing compositions, a 25 gram dose of automatic dishwashing composition per wash delivers 9,875 TAU of Maxamyl amylase and 787.500 ADU of Protein Engineered Maxacal 42 protease. Maxapem 42/Maxatase protease 250–1,000 KADU/KDU and Maxamyl 4,000–10,000 TAU per wash. At a concentration of 1.75%, Maxatase, 1.75% Protein Engineered Maxapem 42 (Maxapem 42) and 1.0% Maxamyl in the instant automatic dishwashing compositions, a 25 gram does of automatic dishwashing composition per wash delivered 9,875 TAU of Maxamyl amylase and 656,250 DU/ADU of protease enzymes.

The weight ratio of the one or two protease enzymes (Maxatase and Maxapem 42) taken together to the amylolytic enzyme in the nonaqueous liquid automatic dishwasher detergent compositions is about 6:1 to about 1.1:1, more preferably about 4.5:1 to about 1.2:1. The weight ratio of Maxatase to Protein Engineered Maxapem 42 is about 1.8:1 to about 1:1.

Another useful amylase enzyme sold by Novo is Termamyl 300 1Dx having an activity of 300 KNU/g. It is an alphaamylase prepared by submerged fermentation of a selected strain of *Bacillus liceniformis.*

Another useful protease enzyme is Savinase 16.OL Type, Ex sold by Novo. It has an actively of 16.KNPU/g and is prepared by submerged fermentation of an alcalophilic strain of Bacillus. Another useful protease enzyme is Durazym 16.0 L Type Ex which is sold by Novo and has an activity of 16DPU/g. It is a protein-engineered variant of Savinase. Another protease enzyme is available under the name Maxacal which is supplied by Gist-Brocades, of the Netherlands in a prill form (activity of about 400 KADU/g) (Maxacal CST450,000). Preferred enzyme activates per wash are Maxacal 200 to enzyme is coated with a polyethylene glycol coating 700 KADU/g and Maxamyl 625 to 4000 TAU/g per wash.

The weight ratio of the proteolytic enzyme to the amylolytic enzyme in the powdered automatic dishwasher detergent compositions is about 8:1 to about 1:1, and more preferably about 4.5:1 to about 1.1:1.

The detergent composition can have a fairly wide ranging composition. The surfactant can comprise about 0 to 15 percent by weight of the composition, more preferably about 0.1 to 15 percent by weight, and most preferably about 1 to about 12 percent by weight. The soil suspending agent which is preferably a copolymerized polyacrylic acid will be present in an amount of about 0 to about 20 percent by weight, more preferably about 3 to about 15 percent by weight and most preferably about 5 to about 15.0 percent by weight. The anti-foaming agent will be present in an amount of about 0 to about 1.5 percent by weight, more preferably about 0.1 to about 1.2 percent by weight and most preferably about 0.3 to about 1 percent by weight. The builder system, which is preferably an alkali metal tripolyphosphate and/or an alkali metal pyrophosphate, is present in an amount of about 2 to about 40 percent by weight, more preferably about 4 to about 40 percent by weight and most preferably about 5 to about 35 percent by weight for a standard product, however, for a concentrated formula, the alkali metal tripolyphosphate is present in an amount of about 10 to 65 wt. percent, more preferably about 15 to 65 percent by weight and most preferably about 15 to 62 percent by weight. The builder system also can contain a low molecular weight non-cross-linked polyacrylate type polymer at a concentration level of about 0 to about 20 weight percent, more preferably 1.0 to about 17 weight percent and most preferably about 2 to about 14 weight percent.

The alkali silicate, which is a corrosion inhibitor, wherein sodium disilicate is preferred, will be present in an mount of about 0 to 30 percent by weight, more preferably about 3 to about 30 percent by weight and most preferably about 4 to about 28 percent by weight.

The opacifier will be present in an mount of about 0 to about 1.0 percent by weight, more preferably about 0.1 to about 7 percent by weight and most preferably about 0.5 percent by weight.

The enzymes will be present in a prilled form as supplied by Gist Brocades at a concentration of about 0.8 to 22.0 percent by weight, more preferably about 0.9 to 20.0 percent by weight, and most preferably about 1.0 to about 18.0 percent by weight. The protease enzyme prills in the automatic dishwashing composition will comprise about 0.5 to about 15.00 percent by weight, more preferably about 0.7 to about 13.0 weight percent and most preferably about 0.8 to about 11.0 percent by weight. The amylase enzyme prills will comprise about 0.3 to about 8.0 percent by weight, more preferably about 0.4 percent to about 7.0 weight percent and most preferably about 0.5 to about 6.0 weight percent. The lipase enzyme prills will comprise about 0.00 to about 8.0 percent by weight of the detergent composition. A typical lipase enzyme is Lipolas 100 T from Novo Nordisk of Denmark. The lipase enzymes are especially beneficial in reducing grease residues and related filming problems on glasses and dishware. Another useful lipase enzyme is Amaneo PS lipase provided by Amaneo International Enzyme Co., Inc.

Other components such as perfumes will comprise about 0.1 to about 5.0 percent by weight of the detergent composition.

The detergent powder formulation having a bulk density of about 0.75 to 1.05 kg/liter, more preferably about 0.8 to about 1.0 kg/liter can be produced by forming an agglomerated bead comprising a core and at least one coating absorbed into and deposited on the core. The core can comprise an alkali metal phosphate detergent builder salt and optionally an alkali metal phosphate free detergent builder salt, an alkali metal silicate, an alkali metal sulfate, an alkali metal perborate, and an alkali metal low molecular weight non-cross-linked polyacrytate. The coating comprises the nonionic surfactant which is sprayed dried by conventional means onto the core to form the agglomerated beads which are substantially dried. The nonionic surfactant coating can also contain the antifoaming agent as well as the alkali metal low molecular non-cross-linked polymer in which case the core does not contain any of the polyacrytate polymer. A second outer coating of the alkali metal silicate can be spray dried onto the nonionic surface coating in which case the core does not contain the alkali metal silicate. A blend is formed by drying blending means of the protease enzyme, the amylase enzyme and optionally the alkali metal perborate, the alkali metal perborate activity, the alkali metal sulfate and the antifoaming agent. If the blend contains the alkali metal sulfate, antifoaming agent or alkali metal perborate, these materials will not be contained in the agglomerated bead. The blend containing the enzymes is dry blended by any conventional dry blending technique. The activity of the enzyme is not diminished during storage because the alkaline materials that are contained within the core of the beads are physically separated from the enzymes. It is a well established fact that alkaline materials have an adverse effect on the activity and stability of the enzymes. In the instant compositions the alkaline metals are physically separated from the enzymes which are contained in the blend whereas the alkaline materials are contained in the agglomerated beads. If the alkali metal perborate or the alkali metal sulfate are contained in the blend, then they are not contained in the agglomerated beads.

The instant compositions also can be produced as low density powders according to the procedure as set forth in U.S. Pat. No. 4,931,203 which is hereby incorporated by reference, wherein these powders have a bulk density of about 0.55 to about 0.75 kg/liter.

The concentrated powdered nonionic automatic dishwashing detergent compositions of the present invention disperses readily in the water in the dishwashing machine. The presently used home dishwashing machines have a measured capacity for about 80 cc or 90 grams of detergent. In normal use, for example, for a full load of dirty dishes 60 grams of powdered detergent are normally used.

In accordance with the present invention only about 56 cc or about 50 grams of the standard powdered detergent composition is needed whereas the dose of concentrated detergent is 33 g weight. The normal operation of an automatic dishwashing machine can involve the following steps or cycles: washing, rinse cycles with cold/hot water and rinse cycles with hot water. The entire wash and rinse cycles require about 60 minutes. The temperature of the wash water is about 40° C. to about 65° C. and the temperature of the rinse water is about 55° C. to about 65° C. The wash and rinse cycles use about 4 to 7.5 liters of water for the wash cycle and about 4 to 7.5 liters of water for the hot rinse cycle.

The concentrated powdered automatic dishwashing detergent compositions exhibit excellent cleaning properties and because of the high concentration of the detergent in the composition, the detergent is not totally consumed during the wash cycle or totally eliminated during the rinse cycle such that there is a sufficient amount of detergent remaining during the rinse cycle to substantially improve the rinsing. The washed and dried dishes are free of undesirable traces, deposits or film due to the use of hot water in the rinse cycle.

DESCRIPTION OF THE PREFERRED EMBODIMENTS

EXAMPLE 1

Standard Density Powder Auto-Dish Detergent Composition

A free flowing, highly soluble standard density powder auto-dish detergent was developed by absorbing nonionic surfactant (Union Carbide Tergitol MDS-42) on highly absorptive sodium tripolyphosphate Oxy Chem HRS 3342. High soluble sodium silicate (PQ Corporation HS 240), granular sodium sulfate (Kerr-McGee Corporation Trona), granular sodium carbonate (Allied Chemical dense soda ash) were also necessary to give necessary flow property and high solubility of the detergent. Product was made by dry blending all the ingredients.

TABLE I

| Ingredients | Amount | Concentration |
|---|---|---|
| Sodium Tripolyphosphate (Oxy Chem HRS 3342) | 144 g | 36% |
| Anhydrous Sodium Sulfate-Trona Gran. | 104 | 26 |
| Anhydrous Sodium Carbonate-Allied Dense | 88 | 22 |
| Hydrated Sodium Silicate - PQ HS 240 | 48 | 12 |
| Nonionic Surfactant - Tergitol MDS-42 | 16 | 4 |
| Maxacal P 400,000 - Gist-Brocades | 0 | 0 |
| Maxamyl P 5000 - Gist-Brocades | 0 | 0 |
| | 100 | 400 g |

Amount of Maxacal P 400,000 and Maxamyl P 5,000 prilled enzymes were incorporated in the powder ADD general formula as exemplified in Table I by replacing equivalent amount of sodium sulfate in the product. Rest of the ingredients and the amount remained same in the product.

The finished product was aged over a period of two days to give a nice dry free-flowing powder. The product was tested with 50 g dose using the ASTM spotting and filming test method combined with denatured egg soiled (egg yolk denatured with 2.5M $CaCl_2$ solution) along with baked-on oatmeal soiled substrates against non-enzyme powder ADD, bleach-containing powder ADD prototype and CASCADE powder ADD supplied +P+G with 50 g dose and PALMOLIVE AUTOMATIC Liquid ADD supplied by Colgate Palmolive with 80 g dose. The cleaning performance tests were mn at 120° F. wash cycle temperatures using tap water (ca. 115 ppm water hardness).

TABLE II

Auto-Dish Performance (Enzyme vs. Non-Enzyme vs. Bleach-Based Product)
In Tap Water at 120° F. Wash Cycle Temperature

| Auto-Dish Products | Enzymes Maxacal | Conc. % Maxamyl | Dose g | Performance, Cleaning: Denatured Egg | Performance, Cleaning: Baked-On Porridge |
|---|---|---|---|---|---|
| 1 | 0 | 0 | 50 g | 5.5% | 60% |
| 2 | 0 | 1.0 | 50 g | 30.5 | 99.5 |
| 3 | 2 | 0 | 50 g | 95.0 | 60 |
| 4 | 2 | 1.5 | 50 g | 98.5 | 99.5 |
| 5 | 2 | 0.5 | 50 g | 95.0 | 98.5 |
| 6 | 1.5 | 0.25 | 50 g | 94.0 | 95.5 |
| 7 | 1 | 0.5 | 50 g | 93.0 | 100.0 |
| 8 | 1 | 0.25 | 50 g | 94.5 | 100.0 |
| 9 | 1 | 0.25 | 50 g | 68.5 | 100.0 |
| Powder PADD 11614-90B (contain 1.2% AV.Cl) | | | 50 g | 91.5 | 60 |
| CASCADE Powder (contain 1% Av.Cl) | | | 50 g | 63.0 | 60 |
| PALM AUTO Liq (contain 1% Av.Cl) | | | 80 g | 91.0 | 60 |

Non-enzyme poser ADD Conrol (1) barely cleaned any egg and starch soil whereas incorporation of Maxacal and Maxamyl helped complete removal egg and starchy soil respectively. Enzymes (both Maxacal and Maxamyl) containing powders (2–9) outperformed chlorine bleach containing ADDs like PADD 11614-90B, CASCADE powder and PALMOLIVE AUTOMATIC Liquid in cleaning egg and starchy soil.

TABLE III

Auto-Dish Products ASTM Spotting/Filming Performance Data
300 ppm Water Hardness, 120° F. Wash Cycle Temperature

| Auto-Dish Products | Spotting/Filming Data |
|---|---|
| Powder Auto-Dish (3) | 1st Cycle A 3 |
| | 2nd Cycle A 3 |
| | 3rd Cycle A 3, 4 |
| | 4th Cycle A 2, 3 |
| Powder ADD 11614-90B (Chlorine Bleach) | 1st Cycle B 5 |
| | 2nd Cycle B 5 |
| | 3rd Cycle B 5 |
| | 4th Cycle B 3, 4 |
| CASCADE Powder (Chlorine Bleach) | 1st Cycle A 5 |
| | 2nd Cycle A 6 |
| | 3rd Cycle AB 6 |
| | 4th Cycle A 3 |
| Palmolive Automatic ADD (Chlorine Bleach) | 1st Cycle BC 3, 4 |
| | 2nd Cycle CD 4 |
| | 3rd Cycle D 4, 5 |
| | 4th Cycle DE 2, 3 |

Spotting Scale:
A best; no spots
B very few spots
C approx. 25% spot coverage
D approx. 50% spot coverage
E excessive spots
Filming Scale:
1 best
2 slight film
3 noticeable film
4 significant film
5 excessive film

TABLE IV

| Ingredients | Concentration |
|---|---|
| Sodium Tripolyphosphate (Base Bead - DCP 151-627) | 61.00% |
| Sodium Carbonate (Allied Chemical Dense Soda Ash) | 10.00 |
| Sodium Metasilicate (1 $Na_2O$: 1 $SiO_2$, PQ Metsobeads 2048) | 6.00 |
| Sodium Silicate (1 $Na_2O$: 1 $SiO_2$, PQ Britesil LD24) | 12.00 |
| Nonionic Surfactant (Union Carbide Tergitol MDS-42) | 6.00 |
| Maxacal P 400,000 (Gist-Brocades) | 3.50 |
| Maxamyl P 5,000 (Gist-Brocades) | 1.50 |

The finished product is aged over two days to give a nice dry free-flowing powder.

Laboratory performance of the compositions of Example 2 were carded out using multisoils. This was done to show differences between the prototype formulations and commercial products. Egg soil was prepared by mixing egg yolk with an equal amount of 2.5N calcium chloride solution. This mixture was applied as thin cross-wise film to the usable surface of 7.5 inch china plates. The plates were aged in 50% relative humidity overnight. Oatmeal soil was prepared by boiling 24 grams of Quaker Oats in 400 ml of tap water for ten minutes. Three grams of this mixture was spread as thin film onto a 7.5 inch china plate. The plates were aged for 2 hours at 80° C. They were then stored overnight at room temperature. Two plates of each egg and oatmeal were used per wash. The plates were placed in the same positions in the dishwasher. Thirty-five grams of the detergent was used as a single dose per wash. All plates were scored by measuring the percent area cleaned. The multi-soil cleaning test results are reported below. The results tabulated in Table V were average of at least 2 runs. Average results reflect the average performance results obtained in three different water conditions. The product was tested with 33 g dose using the ASTM method D3556-79 spotting and filming test method combined with denatured egg soiled (egg yolk denatured with 2.5M $CaCl_2$ solution) along with the 50 g dose of commercial powder product. Enzyme containing prototype powder ADD completely removed egg soil kid of oatmeal, whereas, commercial Powder barely removed any of the egg and oatmeal soil.

TABLE V

Cleaning Performance Enzyme vs. Non-Enzyme Based Products

| | | % Cleaning | |
|---|---|---|---|
| Product | Dose | Denatured Egg | Baked-On Oatmeal |
| Concentrated ADD Product (Example 2) | 33 g | 100% | 100% |
| CASCADE Powder (Commercial Powder) | 50 g | 40% | 50% |

EXAMPLE 3

Standard Density Powder Auto-Dish Detergent Composition

A free flowing, highly soluble standard density powder auto-dish detergent was developed by absorbing nonionic surfactant (Union Carbide Tergitol MDS-42) on highly absorptive sodium tripolyphosphate (Oxy Chem HRS3342). High soluble sodium silicate (PQ Corporation HS 240), granular sodium sulfate (Kerr-McGee Corporation Trona), granular sodium carbonate (Allied Chemical dense soda ash) were also necessary to give necessary flow property and high solubility of the detergent. Product was made by dry blending all the ingredients.

TABLE VI

| Ingredients | Amount | Concentration |
|---|---|---|
| Sodium Tripolyphosphate (Oxychem HRS3342) | 144 g | 36% |
| Anhydrous Sodium Sulfate-Trona Gran. | 104 | 26 |
| Anhydrous Sodium Carbonate-Allied Dense | 88 | 22 |
| Hydrated Sodium Silicate PQ - HS 240 | 48 | 12 |
| Nonionic Surfactant - Tergitol MDS-42 | 16 | 4 |
| Maxapem CX 30 MPU - Gist-Brocades | 0 | 0 |
| Maxamyl P 5000 - Gist-Brocades | 0 | 0 |
| Gist-Brocades | 400 g | 100% |

Amount of Maxapem 30 and Maxamyl enzymes were incorporated in the powder ADD general formula as exemplified in Table VI by replacing equivalent amount of sodium sulfate in the product. Rest of the ingredients and the amount remained same in the product.

The finished product was aged over a period of two days to give a nice dry free-flowing powder. The product was tested with 50 g dose using the ASTM spotting and filming test method combined with denatured egg soiled (egg yolk denatured with 2.5M $CaCl_2$ solution) along with baked-on oatmeal soiled substrates against non-enzyme powder ADD, bleach-containing powder ADD prototype and CASCADE, a commercial powder ADD with 50 g dose and PALMOLIVE AUTOMATIC, a commercial Liquid ADD with 80 g dose. The cleaning performance tests were run at 120° F. wash cycle temperatures using tap water (ca. 115 ppm water hardness).

TABLE VII

Auto-Dish Performance (Enzyme vs. Non-Enzyme vs. Bleach-Based Product)
In Tap Water at 120° F. Wash Cycle Temperature

| | Enzyme Conc. % | | | | Cleaning |
|---|---|---|---|---|---|
| Auto-Dish Products | Maxapem 30 | Maxamyl | Dose g | Denatured Egg | Baked-On Porridge |
| 1 | 0 | 0 | 50 g | 6.5% | 60.0% |
| 2 | 0 | 1 | 50 g | 30.5 | 99.5 |
| 3 | 2 | 0 | 50 g | 98.0 | 60.0 |
| 4 | 2 | 1.5 | 50 g | 99.0 | 99.5 |
| 5 | 2 | 0.5 | 50 g | 95.0 | 98.5 |
| 6 | 1.5 | 0.25 | 50 g | 94.0 | 95.5 |
| 7 | 1 | 0.5 | 50 g | 93.0 | 100.0 |
| 8 | 1 | 0.25 | 50 g | 94.5 | 100.0 |
| 9 | 1 | 0.25 | 50 g | 68.5 | 100.0 |
| Powder PADD 11614-90B (contain 1.2% Av.Cl) | | | 50 g | 91.5 | 60.0% |
| CASCADE Powder (contain 1% Av.Cl) | | | 50 g | 63.0 | 60.0% |
| PALM AUTO Liq (contain 1% Av.Cl) | | | 80 g | 91.0 | 60.0% |

Non-enzyme poser ADD Conrol (1) barely cleaned any egg and starch soil whereas incorporation of Protein Engineered 42 Maxacal and Maxamyl helped complete removal egg and starchy soil respectively. Enzymes (both Maxapem 30 and Maxamyl) containing powders (2–9) outperformed chlorine bleach containing ADDs like PADD 11614-90B, CASCADE, a commercial powder and PALMOLIVE AUTOMATIC, a commercial Liquid in cleaning egg and starchy soil.

TABLE VIII

Auto-Dish Products ASTM Spotting/Filming Performance Data
300 ppm Water Hardness, 120° F. Wash Cycle Temperature

| Auto-Dish Products | Spotting/Filming Data |
|---|---|
| Powder Auto-Dish (3) | 1st Cycle A 3 |
| | 2nd Cycle A 3 |
| | 3rd Cycle A 3, 4 |
| | 4th Cycle A 2, 3 |
| Powder ADD 11614-90B (Chlorine Bleach) | 1st Cycle B 5 |
| | 2nd Cycle B 5 |
| | 3rd Cycle B 5 |
| | 4th Cycle B 3, 4 |
| CASCADE Powder (Chlorine Bleach) | 1st Cycle A 5 |
| | 2nd Cycle A 6 |
| | 3rd Cycle AB 6 |
| | 4th Cycle A 3 |
| PALMOLIVE AUTOMATIC Liquid (Chlorine Bleach) | 1st Cycle BC 3, 4 |
| | 2nd Cycle CD 4 |
| | 3rd Cycle D 4, 5 |
| | 4th Cycle DE 2, 3 |

Spotting Scale:
A best- no spots
B very few spots
C approx. 25% spot coverage
D approx. 50% spot coverage
E excessive spots
Filming Scale:
1 best - no film
2 slight film
3 noticeable film
4 significant film
5 excessive film

EXAMPLE 4

According to the procedure of U.S. Pat. No. 4,931,203 the following concentrated formulation was produced:

TABLE IX

| Ingredients | Concentration |
|---|---|
| Sodium Tripolyphosphate Base Bead - D CP 151-627 | Protein |
| Sodium Carbonate (Allied Chemical Dense Soda Ash) | 10.00 |
| Sodium Metasilicate (1 $Na_2O$: 1 $SiO_2$, PQ Metsobeads 2048) | 6.00 |
| Sodium Silicate (1 $Na_2O$: 1 $SiO_2$, PQ Britesil LD24) | 12.00 |
| Nonionic Surfactant (Union Carbide Tergitol MDS-42) | 6.00 |
| Maxapem CX 30 (Gist-Brocades) Maxamyl P 5,000 (Gist-Brocades) | 1.50 |

The finished product is aged over two days to give a nice dry free-flowing powder.

Laboratory performance of the compositions of Example 2 were carried out using multi-soils. This was done to show differences between the prototype formulations and commercial products. Egg soil was prepared by mixing egg yolk with an equal amount of 2.5N calcium chloride solution. This mixture was applied as thin cross-wise film to the usable surface of 7.5 inch china plates. The plates were aged in 50% relative humidity overnight. Oatmeal soil was prepared by boiling 24 grams of Quaker Oats in 400 ml of tap water for ten minutes. Three grams of this mixture was spread as thin film onto a 7.5 inch china plate. The plates were aged for 2 hours at 80° C. They were then stored overnight at room temperature. Two plates of each egg and oatmeal were used per wash. The plates were placed in the same positions in the dishwasher. Thirty-three grams of the detergent was used as a single dose per wash. All plates were scored by measuring the percent area cleaned. The multi-soil cleaning test results are reported below. The results tabulated in Table X were average of at least 2 runs. Average results reflect the average performance results obtained in three different water conditions. The product was tested with 33 g dose using the ASTM Method D3556-79 spotting and filming test method combined with denatured egg soiled (egg yolk denatured with 2.5M $CaCl_2$ solution) along with the 50 g dose of commercial powder product. Enzyme containing prototype powder ADD completely removed egg soil and major portion of oatmeal, whereas, CASCADE, a commercial powder barely removed any of the egg and oatmeal soil.

TABLE X

Cleaning performance Enzyme vs. non-Enzyme Based Product

| Product | Dose | % Cleaning | |
|---|---|---|---|
| | | Denatured Egg | Baked-On Oatmeal |
| Concentrated ADD Product (Example 2) | 33 g | 100% | 100% |
| CASCADE Powder (Commercial Product) | 50 g | 40% | 50% |

EXAMPLE 5

Standard Density Powder Auto-Dish Detergent Composition

A free flowing, highly soluble standard density powder auto-dish detergent was developed by absorbing nonionic surfactant (Union Carbide Tergitol MDS-42) on highly absorptive sodium tripolyphosphate (Oxy Chem HRS3342). High soluble sodium silicate (PQ Corporation HS 240), granular sodium sulfate (Kerr-McGee Corporation Trona), granular sodium carbonate (Allied Chemical dense soda ash) were also necessary to give necessary flow property and high solubility of the detergent. Product was made by dry blending all the ingredients.

TABLE XI

| Ingredients | Concentration |
|---|---|
| Sodium Tripolyphosphate (Oxy Chem HRS3342) | 36 |
| Anhydrous Sodium Sulfate-Trona Gran. | 26 |
| Anhydrous Sodium Carbonate-Allied Dense | 22 |
| Hydrated Sodium Silicate - PQ HS 240 | 12 |
| Nonionic Surfactant - Tergitol MDS-42 | 4 |
| Maxatase - Gist Brocades | 0 |
| Maxamyl P 5000 - Gist-Brocades | 0 |
| | 100 g |

Amount of Maxatase P440,000 and Maxamyl P5,000 prilled enzymes were incorporated in the powder ADD general formula as exemplified in Table XI by replacing equivalent amount of sodium sulfate in the product. Rest of the ingredients and the amount remained same in the product.

The finished product was aged over a period of two days to give a nice dry free-flowing powder. The product was tested with 50 g dose using the ASTM spotting and filming test method combined with denatured egg soiled (egg yolk denatured with 2.5M $CaCl_2$ solution) along with baked-on oatmeal soiled substrates against non-enzyme powder ADD, bleach-containing powder ADD prototype and a commercial (CASCADE) powder ADD with 50 g dose and a commercial (PALMOLIVE AUTOMATIC) Liquid ADD with 80 g dose. The cleaning performance tests were run at 120° F. wash cycle temperatures using tap water (ca. 115 ppm water hardness).

TABLE XII

Auto-Dish Performance (Enzyme vs. Non-Enzyme vs. Bleach-Based Product)
In Tap Water at 120° F. Wash Cycle Temperature

| Auto-Dish Products | Enzymes Maxatase | Conc. % Maxamyl | Dose g | Performance, Detured Egg | % Cleaning Baked-On Porridge |
|---|---|---|---|---|---|
| 1 | 0 | 0 | 50 g | 7.5 | 60.0% |
| 2 | 0 | 1 | 50 g | 32.0 | 99.0 |
| 3 | 2 | 0 | 50 g | 95.0 | 60.0 |
| 4 | 2 | 1.5 | 50 g | 98.5 | 99.5 |
| 5 | 2 | 0.5 | 50 g | 95.0 | 98.5 |
| 6 | 1.5 | 0.25 | 50 g | 96.0 | 96.0 |
| 7 | 1 | 0.5 | 50 g | 96.0 | 100.0 |
| 8 | 1 | 0.25 | 50 g | 95.0 | 100.0 |
| 9 | 1 | 0.25 | 50 g | 70.5 | 100.0 |
| Powder ADD 11614-90B (contain 1.2% Av. Cl) | | | 50 g | 91.5 | 60.0 |
| Commercial Powder (contain 1% Av. Cl) | | | 50 g | 63.0 | 60.0 |
| Commercial Liq (contain 1% Av. Cl) | | | 80 g | 91.0 | 60.0 |

Non-enzyme poser ADD Conrol (1) barely cleaned any egg and starch soil whereas incorporation of Maxatase and Maxamyl helped complete removal egg and starchy soil respectively. Enzymes (both Maxatase and Maxamyl) containing powders (2–9) outperformed chlorine bleach containing ADDs like PADD 11614-90B, commercial powder and commercial Liquid in cleaning egg and starchy soil.

TABLE XIII

Auto-Dish Products ASTM Spotting/Filming Performance Data
300 ppm Water Hardness, 120° F. Wash Cycle Temperature

| Auto-Dish Products | Spotting/Filming Data |
|---|---|
| Powder Auto-Dish (3) | 1st Cycle A 3 |
| | 2nd Cycle A 3 |
| | 3rd Cycle A 3, 4 |
| | 4th Cycle A 2, 3 |
| Powder ADD 11614-90B (Chlorine Bleach) | 1st Cycle B5 |
| | 2nd Cycle B5 |
| | 3rd Cycle B5 |
| | 4th Cycle B 3, 4 |
| Commercial Powder (Chlorine Bleach) | 1st Cycle A 5 |
| | 2nd Cycle A 6 |
| | 3rd Cycle AB 6 |
| | 4th Cycle A 3 |
| Commercial Liquid (Chlorine Bleach) | 1st Cycle BC 3, 4 |
| | 2nd Cycle CD 4 |
| | 3rd Cycle D 4,5 |
| | 4th Cycle DE 2, 3 |

TABLE XIII-continued

Auto-Dish Products ASTM Spotting/Filming Performance Data
300 ppm Water Hardness, 120° F. Wash Cycle Temperature

| Auto-Dish Products | Spotting/Filming Data |
|---|---|
| Spotting Scale: | |
| A best, no spots | |
| B very few spots | |
| C approx. 25% spot coverage | |
| D approx. 50% spot coverage | |
| E excessive coverage spots | |
| Filming Scale: | |
| 1 best, no film | |
| 2 slight film | |
| 3 noticeable film | |
| 4 significant film | |
| 5 examine film | |

EXAMPLE 6

According to the procedure of U.S. Pat. No. 4,931,203 the following concentrated formulation was produced:

TABLE XIV

| Ingredients | Concentration |
|---|---|
| Sodium Tripolyphosphate Base Bead - DCP 151-627 | 61.00% |
| Sodium Carbonate (Amed Chemical Dense Soda Ash) | 10.00 |
| Sodium Metasilicate (1 $Na_2O$: I $SiO_2$, PQ Metosobeads 2048) | 6.00 |
| Sodium Silicate (1 $Na_2O$: 1 $SiO_2$, PQ Britesd LD24) | 12.00 |
| Nonionic Surfactant (Union Carbide Tergitol MDS-42) | 6.00 |
| Maxatase P 440,000 (Gist Brocades) | 3.50 |
| Maxamyl P 5,000 (Gist Brocades) | 1.50 |

The finished product is aged over two days to give a nice dry free-flowing powder.

Laboratory performance of the compositions of Example 2 were carried out using multi-soils. This was done to show differences between the prototype formulations and commercial products. Egg soil was prepared by mixing egg yolk with an equal amount of 2.5N calcium chloride solution. This mixture was applied as thin cross-wise film to the usable surface of 7.5 inch china plates. The plates were aged in 50% relative humidity overnight. Oatmeal soil was prepared by boiling 24 grams of Quaker Oats in 400 ml of tap water for ten minutes. Three grams of this mixture was spread as thin film onto a 7.5 inch china plate. The plates were aged for 2 hours at 80° C. They were then stored overnight at room temperature. Two plates of each egg and oatmeal were used per wash. The plates were placed in the same positions in the dishwasher. Thirty-three grams of the detergent was used as a single dose per wash. All plates were scored by measuring the percent area cleaned. The multi-soil cleaning test results are reported below. The results tabulated in Table XV were average of at least 2 runs. Average results reflect the average performance results obtained in three different water conditions.

The product was tested with 33 g dose using the ASTM method D 3556-79 spotting and filming test method combined with denatured egg soiled (egg yolk denatured with 2.5M $CaCl_2$ solution) along with the 50 g dose. Enzyme containing prototype powder ADD completely removed egg soil and of commercial powder product oatmeal, whereas, commercial Powder barely removed any of the egg and oatmeal soil.

TABLE XV

Cleaning performance Enzyme vs. non-Enzyme based product.

| Product | Dose | % Cleaning Denatured Egg - | % Cleaning Baked-on Oatmeal |
|---|---|---|---|
| Commercial ADD Product (Example 2) | 33 g | 100% | 100% |
| CASCADE Powder (Commercial powder) | 50 g | 40% | 50% |

EXAMPLE 7

Standard Density Powder Auto-Dish Detergent Composition

A free flowing, highly soluble standard density powder auto-dish detergent was developed by absorbing nonionic surfactant (Union Carbide Tergitol MDS-42) on highly absorptive sodium tripolyphosphate (Oxy Chem HRS3342). High soluble sodium silicate (PQ Corporation HS 240), granular sodium sulfate (Kerr-McGee Corporation Trona), granular sodium carbonate (Allied Chemical dense soda ash) were also necessary to give necessary flow property and high solubility of the detergent. Product-was made by dry blending all the ingredients.

TABLE XVI

| Ingredients | Amount | Concentration |
|---|---|---|
| Sodium Tripolyphosphate (Oxy Chem HRS3342) | 144 g | 36% |
| Anhydrous Sodium Sulfate-Trona Gran. | 104 | 26 |
| Anhydrous Sodium Carbonate-Allied Dense | 88 | 22 |
| Hydrated Sodium Silicate - PQ HS 240 | 48 | 12 |
| Nonionic Surfactant - Tergitol MDS-42 | 16 | 4 |
| Maxatase - Gist Brocades | 0 | 0 |
| Maxamyl P 5000 - Gist-Brocades | 0 | 0 |
| | 400 g | 100% |

Amount of Maxatase P440,000 and Maxamyl P5,000 prilled enzymes were incorporated in the powder ADD general formula as exemplified in Table XVI by replacing equivalent amount of sodium sulfate in the product. Rest of the ingredients and the amount remained same in the product.

The finished product was aged over a period of two days to give a nice dry free-flowing powder. The product was tested with 50 g dose using the ASTM spotting and filming test method combined with denatured egg soiled (egg yolk denatured with 2.5M $CaCl_2$ solution) along with baked-on oatmeal soiled substrates against non-enzyme powder ADD, bleach-containing powder ADD prototype and a commercial (CASCADE) powder ADD with 50 g dose and a commercial (PALMOLIVE AUTOMATIC) Liquid ADD with 80 g dose. The cleaning performance tests were run at 120° F. wash cycle temperatures using tap water (ca. 115 ppm water hardness).

TABLE XVII

Auto-Dish Performance (Enzyme vs. Non-Enzyme vs. Bleach-Based Product)
In Tap Water at 120° F. Wash Cycle Temperature

| Auto-Dish Products | Enzymes Maxatase | Conc. % Maxamyl | Dose g | Performance, Detured Egg | % Cleaning Baked-On Porridge |
|---|---|---|---|---|---|
| 1 | 0 | 0 | 50 g | 7.5 | 60.0% |
| 2 | 0 | 1 | 50 g | 32.0 | 99.0 |
| 3 | 2 | 0 | 50 g | 95.0 | 60.0 |
| 4 | 2 | 1.5 | 50 g | 98.5 | 99.5 |
| 5 | 2 | 0.5 | 50 g | 95.0 | 98.5 |
| 6 | 1.5 | 0.25 | 50 g | 96.0 | 96.0 |
| 7 | 1 | 0.5 | 50 g | 96.0 | 100.0 |
| 8 | 1 | 0.25 | 50 g | 95.0 | 100.0 |
| 9 | 1 | 0.25 | 50 g | 70.5 | 100.0 |
| Powder ADD 11614-90B (contain 1.2% Av. Cl) | | | 50 g | 91.5 | 60.0 |
| Commercial Powder (contain 1% Av. Cl) | | | 50 g | 63.0 | 60.0 |
| Commercial Liq (contain 1% Av. Cl) | | | 80 g | 91.0 | 60.0 |

Non-enzyme poser ADD Conrol (1) barely cleaned any egg and starch soil whereas incorporation of Maxatase and Maxamyl helped complete removal egg and starchy soil respectively. Enzymes (both Maxatase and Maxamyl) containing powders (2–9) outperformed chlorine bleach containing ADDs like PADD 11614-90B, commercial powder and commercial Liquid in cleaning egg and starchy soil.

TABLE XVIII

Auto-Dish Products ASTM Spotting/Filming Performance Data
300 ppm Water Hardness, 120° F. Wash Cycle Temperature

| Auto-Dish Products | Spotting/Filming Data |
|---|---|
| Powder Auto-Dish (3) | 1st Cycle A 3<br>2nd Cycle A 3<br>3rd Cycle A 3, 4<br>4th Cycle A 2, 3 |
| Powder ADD 11614-90B (Chlorine Bleach) | 1st Cycle B5<br>2nd Cycle B5<br>3rd Cycle B5<br>4th Cycle B 3, 4 |
| Commercial Powder (Chlorine Bleach) | 1st Cycle A 5<br>2nd Cycle A 6<br>3rd Cycle AB 6<br>4th Cycle A 3 |
| Commercial Liquid (Chlorine Bleach) | 1st Cycle BC 3, 4<br>2nd Cycle CD 4<br>3rd Cycle D 4, 5<br>4th Cycle DE 2, 3 |

Spotting Scale:
A best, no spots
B very few spots
C approx. 25% spot coverage
D approx. 50% spot coverage
E excessive coverage spots
Filming Scale:
1 best, no film
2 slight film
3 noticeable film
4 significant film
5 examine film

EXAMPLE 8

According to the procedure of U.S. Pat. No. 4,931,203 the following concentrated formulation was produced:

TABLE XIX

| Ingredients | Concentration |
|---|---|
| Sodium Tripolyphosphate Base Bead - DCP 151-627 | 61.00% |
| Sodium Carbonate (Allied Chemical Dense Soda Ash) | 10.00 |
| Sodium Metasilicate (1 $Na_2O$: 1 $SiO_2$, PQ Metosobeads 2048) | 6.00 |
| Sodium Silicate (1 $Na_2O$: 1 $SiO_2$, PQ Britesil LD24) | 12.00 |
| Nonionic Surfactant (Union Carbide Tergitol MDS-42) | 6.00 |
| Maxatase P 440,000 (Gist Brocades) | 3.50 |
| Maxamyl P 5,000 (Gist Brocades) | 1.50 |

The finished product is aged over two days to give a nice dry free-flowing powder.

Laboratory performance of the compositions of Example 2 were carried out using multi-soils. This was done to show differences between the prototype formulations and commercial products. Egg soil was prepared by mixing egg yolk with an equal amount of 2.5N calcium chloride solution. This mixture was applied as thin cross-wise film to the usable surface of 7.5 inch china plates. The plates were aged in 50% relative humidity overnight. Oatmeal soil was prepared by boiling 24 grams of Quaker Oats in 400 ml of tap water for ten minutes. Three grams of this mixture was spread as thin film onto a 7.5 inch china plate. The plates were aged for 2 hours at 80° C. They were then stored overnight at room temperature. Two plates of each egg and oatmeal were used per wash. The plates were placed in the same positions in the dishwasher. Thirty-three grams of the detergent was used as a single dose per wash. All plates were scored by measuring the percent area cleaned. The multi-soil cleaning test results are reported below. The results tabulated in Table XX were average of at least 2 runs. Average results reflect the average performance results obtained in three different water conditions.

The product was tested with 33 g dose using the ASTM method D 3556-79 spotting and filming test method combined with denatured egg soiled (egg yolk denatured with 2.5M $CaCl_2$ solution) along with the 50 g dose. Enzyme containing prototype powder ADD completely removed egg soil and of commercial powder product oatmeal, whereas, commercial Powder barely removed any of the egg and oatmeal soil.

TABLE XX

Cleaning performance Enzyme vs. non-Enzyme based product.

| Product | Dose | % Cleaning | |
|---|---|---|---|
| | | Denatured Egg - | Baked-on Oatmeal |
| Commercial ADD Product (Example 2) | 33 g | 100% | 100% |
| CASCADE Powder (Commercial powder) | 50 g | 40% | 50% |

EXAMPLE 9

The following two effective cleaning formulas were prepared by spraying the nonionic onto the tripolyphosphate and dry the formed bead. Then in the order listed in the table, the other ingredients of the formulas were added and mixed therein by dry blending the ingredients together.

TABLE XXI

| Ingredients | Formula, % | |
|---|---|---|
| | A | B |
| Sodium Tripolyphosphate-Anhydrous (FMC) | 33.0 | 33.0 |
| Sodium Polyacrylate-Acusol 445ND (Rohm & Hass) | 8.0 | 8.0 |
| Sodium Citrate Granular (Haarmann & Reimer) | 8.0 | — |
| Sodium Alumino Silicate (Zeofite A) (PG Corp.) | 8.0 | 8.0 |
| Sodium Sulfate-Anhydrous | 4.0 | 8.0 |
| Poly Tergent SLF-18 (NI-Surfactant) (Olin Corp.) | 3.0 | 3.0 |
| Sodium Silicate (1:2.4)-Powder Britesil H24 (PG Corp.) | 20.0 | 20.0 |
| Sodium Perborate-Monohydrate (Interox, Degusaa or Dupont) | 8.0 | 8.0 |
| Tetra Acetyl Ethylene Diamine-TAED (Focus Chemical) | 2.4 | 2.4 |
| Protease-Maxacal CXT 450,000 ADU (IBIS) | 4.0 | 4.0 |
| Amylase-Maxamyl CXT 5,000 TAU (IBIS) | 1.0 | 1.0 |
| EDTA-Tetrasodium Salt-Dehydrate | 0.0 | 4.0 |
| Moisture | 0.6 | 0.6 |

What is claimed is:

1. A free flowing powdered dishwashing composition having improved enzymes stability consisting essentially of a physical mixture of agglomerated beads having a maximum particle size of less than about 2,000 microns of at least one alkali metal detergent builder salt, an alkali metal silicate, a low molecular weight noncrosslinked polyacrylate polymer and a nonionic surfactant and a blend portion of the composition comprising at least one protease enzyme and an amylase enzyme, wherein the maximum particle size of the particles of said blend are less than about 2,000 microns, wherein the agglomerated beads comprises a core of at least one said alkali metal detergent builder salt, said alkali metal silicate and said low molecular weight noncrosslinked polyacrylate polymer and a coating absorbed on said core of said alkali metal detergent builder salt, said alkali metal silicate and said low molecular weight noncrosslinked polyacrylate polymer, said coating comprising said nonionic surfactant, wherein the dishwashing composition consisting essentially of approximately by weight:

(a) 22–40% of an alkali metal carbonate;

(b) about 12 to about 30 percent of said alkali metal silicate;

(c) about 1 to 17 percent of said low molecular weight noncrosslinked polyacrylate polymer having a molecular weight of 2,000 to 80,000.

(d) about 1.0 to about 12.0 percent of said low foaming alkoxylated nonionic surfactant;

(e) about 0.1 to about 1.5 percent of said silicone antifoaming agent;

(f) about 0.5 to about 15.0 percent of at least one said protease enzyme; and (g) about 0.5 to 8.0 percent of said amylase enzyme, said composition having less than 8.0 weight percent of water.

2. The composition according to claim 1 further including about 0.5 to about 20.0 weight percent of an alkali metal perborate, such alkali metal perborate being mixed in said blend portion of at least one said protease enzyme and said amylase enzyme.

3. The composition according to claim 2 further including 0.1 to 5.0 weight percent of an alkali metal perborate activator, said alkali metal perborate activator being mixed in said blend of at least one said protease enzyme said amylase enzyme, and said alkali metal perborate.

4. The composition according to claim 1, further including 0 to about 8.0 weight percent of a lipase enzyme.

5. The composition according to claim 1 further including about 0.5 to about 20.0 weight percent of an alkali metal perborate, said alkali metal perborate being disposed in said core of said agglomerated beads.

6. The composition according to claim 1 further including about 0.1 to about 20.0 weight percent of a sodium alumino silicate.

7. A free flowing powdered dishwashing composition having improved enzymes stability consisting essentially of a physical mixture of agglomerated beads having a maximum particle size of less than about 2,000 microns of at least one alkali metal detergent builder salt, an alkali metal silicate, a low molecular weight noncrosslinked polyacrylate polymer and nonionic surfactant and a blend portion of the composition comprising at least one protease enzyme and an amylase enzyme wherein the maximum particle size of the particles of said blend are less than about 2,000 microns, wherein the agglomerated beads comprises a core of at least one said alkali metal detergent builder salt and said low molecular weight noncrosslinked polyacrylate polymer and a first coating absorbed on said core of said alkali metal detergent builder salt and said low molecular weight noncrosslinked polyacrylate polymer, said first coating comprising said nonionic surfactant and a second coating deposited on said first coating, said second coating comprising said alkali metal silicate, wherein the dishwashing composition consisting essentially of approximately by weight:

(a) about 22 to 40% of an alkali metal carbonate;

(b) about 12% thereof to about 30 percent of said alkali metal silicate;

(c) about 1 to about 17 percent of said low molecular weight noncrosslinked polyacrylate polymer having a molecular weight of 2,000 to 80,000;

(d) about 1.0 to about 12.0 percent of said a low foaming alkoxylated nonionic surfactant;

(e) 0.1 to about 1.5 percent of said silicone antifoaming agent;

(f) about 0.5 to about 15.0 percent of at least one said protease enzyme; and (g) about 0.3 to about 8.0 percent of said amylase enzyme, said composition having less than 8.0 weight percent of water.

8. The composition according to claim 7 further including about 0.5 to about 20.0 weight percent of an alkali metal perborate, such alkali metal perborate being mixed in said blend portion of at least one said protease enzyme and said amylase enzyme.

9. The composition according to claim 7 further including 0.1 to 5.0 weight percent of an alkali metal perborate activator, said alkali metal perborate activator being mixed in said blend of at least one said protease enzyme, said amylase enzyme and said alkali metal perborate.

10. The composition according to claim 7, further including 0 to about 8.0 weight percent of a lipase enzyme.

11. The composition according to claim 8 wherein the concentration of said alkali metal silicate is about 3.0 to 30.0 weight percent.

12. The composition according to claim 7 further including about 0.5 to about 20.0 weight percent of an alkali metal perborate, said alkali metal perborate being disposed in said core of said agglomerated beads.

13. The composition according to claim 7 further including about 0.1 to about 5.0 weight percent of an alkali metal perborate activator, said alkali metal perborate activator being mixed in said blend of at least one said protease enzyme and said amylase enzyme.

14. The composition according to claim 7 further including about 0.1 to about 20.0 weight percent of a sodium alumino silicate.

* * * * *

UNITED STATES PATENT AND TRADEMARK OFFICE

CERTIFICATE OF CORRECTION

PATENT NO. : 5,474,699

DATED : December 12, 1995

INVENTOR(S) : Fahim U. Ahmed, et. al.

It is certified that error appears in the above-indentified patent and that said Letters Patent is hereby corrected as shown below:

Title page, item [54] and col. 1, line 1, delete "poweder" and insert--Powered--therefor--

Signed and Sealed this

Seventh Day of May, 1996

Bruce Lehman

*Attest:*

BRUCE LEHMAN

*Attesting Officer*

*Commissioner of Patents and Trademarks*